US005154956A

United States Patent [19]

Fradrich

[11] Patent Number: 5,154,956

[45] Date of Patent: Oct. 13, 1992

[54] NON-CURLING PRESSURE-SENSITIVE ADHESIVE LABELS WITH RELEASE LINERS

[75] Inventor: Gary H. Fradrich, Manawa, Wis.

[73] Assignee: Lamco Ltd., Inc., Carmel, Ind.

[21] Appl. No.: 463,385

[22] Filed: Jan. 11, 1990

[51] Int. Cl.[5] ..... G09F 3/00

[52] U.S. Cl. ..... 428/40; 40/638; 283/81

[58] Field of Search ..... 428/40, 41, 428; 40/638; 283/81

[56] References Cited

U.S. PATENT DOCUMENTS

| | | | |
|---|---|---|---|
| 1,762,539 | 6/1930 | Adams | 156/196 |
| 3,031,324 | 4/1962 | Jankowski | 428/914 X |
| 3,575,788 | 4/1971 | Funk et al. | 428/352 |
| 3,690,909 | 9/1972 | Finley | 156/233 X |
| 3,944,692 | 3/1976 | Swenson | 428/40 |
| 4,202,925 | 5/1980 | Dabroski | 428/354 X |
| 4,262,058 | 4/1981 | Saunders | 428/543 X |
| 4,542,052 | 9/1985 | Shadbolt et al. | 428/42 X |
| 4,678,690 | 7/1987 | Palmer et al. | 428/40 X |
| 4,809,905 | 3/1989 | Goodman | 428/42 X |
| 4,895,747 | 1/1990 | Birkholtz et al. | 428/43 X |
| 4,913,926 | 4/1990 | Rutkowski | 428/40 X |
| 4,935,288 | 6/1990 | Honaker et al. | 428/207 |
| 4,986,866 | 1/1991 | Ohba et al. | 428/127 X |
| 5,030,492 | 7/1991 | Kurtin | 428/41 |

*Primary Examiner*—Henry F. Epstein
*Attorney, Agent, or Firm*—Finnegan, Henderson, Farabow, Garrett & Dunner

[57] ABSTRACT

A xerographically printable label comprises a layer of sheet material, e.g. paper or polyvinyl chloride film, having a printable upper surface and an adhesive-coated lower surface, and a release liner removably adhering to the lower surface of the layer of sheet material. The release liner comprises a first layer of paper having a release coating on its upper surface and a water-impermeable adhesive on its lower surface, and a layer of textured paper bonded to the first layer by the water-impermeable adhesive. The first paper layer is thus protected from substantial moisture gain or loss, on one side by the release liner, and the other side by the water-impermeable adhesive.

18 Claims, 1 Drawing Sheet

NON-CURLING PRESSURE-SENSITIVE ADHESIVE LABELS WITH RELEASE LINERS

BACKGROUND OF THE INVENTION

This invention relates to pressure-sensitive adhesive-backed sheet materials and, more particularly, to non-curling pressure-sensitive adhesive-backed sheet materials which are temporarily adhered to a release liner.

Adhesive-backed printed or printable sheet products have been in general use for home and business applications for many years. Among the many products made from adhesive-backed sheet stock are labels, name tags, membership tags, etc. These products have become more versatile and easier to use due to the development of pressure-sensitive adhesives. Pressure-sensitive adhesives have the advantage over other types of adhesives of not requiring wetting or heating for activation. It is only necessary to place labels having pressure-sensitive adhesive-coated backs in the desired position on the item to which the label is to be affixed and apply light pressure to bond the label to the item.

Pressure-sensitive adhesive-backed sheet products usually have a temporary, non-adhering protective backing sheet over the adhesive, which enables the user to store and handle the adhesive-coated sheet products without the risk of their accidentally adhering to a surface. The backing sheet, commonly referred to as a release liner, is made from a sheet material, such as paper, and it generally has a release agent, such as silicone, coated onto one of its surfaces The release agent enables the liner to be easily peeled from the label, but also permits the release liner to adhere lightly to the adhesive layer on the back of the label.

The label itself may be made from various materials. For some applications it is desired to make the label from paper because of its low cost. In other applications it is desired to use non-paper substances, such as polymeric sheet material Such materials are often preferred because of their hard surface and lack of sensitivity to moisture. In some instances the label and the release liner are both made from paper. In other instances the label is made from one material, such as polyvinyl chloride, and the release liner is made from a different material, such as paper.

One of the main advantages of pressure-sensitive adhesive-coated labels with release liners is that the labels can be written on or typed on to record information on the label prior to attaching it to a package, file or other item. Information can also be recorded on such labels xerographically by means of laser printers or copying machines Recording information on labels by means of laser printers or copying machines presents no difficulty with respect to curling when the label and the release liner are made from the same material. However, it has been discovered that, if the label is made of polymeric material and the release liner is made of paper, laser printing or copier recording on the label can cause the label to curl. It has been determined that the heat generated by the fusion section of laser printers and copiers causes the curling. It appears that the heat drives moisture from the release liner paper and causes the paper to shrink. The label, on the other hand, is not sensitive to moisture loss and it does not undergo appreciable shrinkage. The net result is that the label tends to curl around the release liner. This is undesirable because it makes the label unattractive and difficult to use.

Prior attempts to eliminate or reduce curling in pressure-sensitive adhesive-backed labels with plastic face sheets and paper-based release liners have led to the development of release liners comprised of a sheet of paper sandwiched between two layers of polyethylene film, with one of the polyethylene layers having a release agent coated on its outer surface. Polyethylene film-covered release liners do not undergo appreciable shrinkage but they suffer from other shortcomings. One shortcoming is that polyethylene film-covered release liners have a tendency to acquire a static electric charge. The static charge prevents the labels from feeding smoothly into laser printer and copying machines.

The problem of static charge build-up on labels with polyethylene film-covered release liners has been partially eliminated by applying a thin layer of tissue paper to the polyethylene layer which does not have the release agent deposited on it. This partial solution has, however, introduced additional problems. For instance, these composite labels are expensive and are often too thick to feed through laser printers and copiers. Furthermore, the tissue itself may swell or shrink from the absorption or loss of moisture.

Another effort to eliminate the problem of curl in composite labels has led to the use of embossed paper as the substrate for the release liner. Embossed paper has less propensity to shrink or swell from moisture loss or gain, apparently because the embossing compensates for the shrinkage or swelling of the paper. Labels with embossed release liners may be less likely to exhibit curling upon being subjected to elevated temperatures but they are not suitable for all uses. The embossed surface of the release liner is often imprinted on the face sheet of the label when the two are pressed together during printing. This problem is particularly acute when the face sheet is made from soft plastic films because these materials tend to conform to the embossed pattern.

The problem of shrinkage due to moisture loss may discourage the use of paper in the manufacture of release liners for plastic laser-printable labels; however, the low cost of paper-based release liners makes their use attractive. Thus, there is a continuing effort to find ways to eliminate shrinkage, swelling and curling problems associated with the use of these liners without introducing other problems.

OBJECTS OF THE INVENTION

It is an object of the invention to provide improved paper release liners for adhesive-backed sheet products.

It is another object of the invention to provide paper-based release liners which have a reduced tendency to shrink or swell.

It is another object of the invention to provide non-curling adhesive-backed labels with paper release liners.

It is another object of the invention to provide a method of reducing shrinkage and swelling in paper release liners.

It is another object of the invention to provide a method of reducing curling in pressure-sensitive adhesive-backed labels with paper release liners.

Other objects and advantages of the invention will become apparent from the following detailed description, when read in conjunction with the drawings.

SUMMARY OF THE INVENTION

In accordance with one aspect of the invention the non-shrinking and non-swelling release liners are made by combining to form a multi-layered construction, a reinforcing sheet of embossed paper, a layer of water-impermeable adhesive, a sheet of flat paper and a coating of a release agent. The embossed paper and the flat paper are bonded together by means of the adhesive, and the release agent is coated on the exposed surface of the sheet of flat paper.

In accordance with another aspect of the invention non-curling labels are made by combining a face sheet of non-shrinking material having a xerographically printable top surface and a water-impermeable adhesive-coated bottom surface and the above-described release liner. The release agent-coated surface of the release liner is removably affixed to the adhesive-coated surface of the face sheet.

BRIEF DESCRIPTION OF THE DRAWING

The invention will be better understood from the following detailed description considered in conjunction with the attached drawings in which.

DETAILED DESCRIPTION OF THE INVENTION

The term "label" is used throughout this description to denote all adhesive-backed sheet products, regardless of size or configuration, which are designed to be affixed to a surface such as a file folder, carton, wall, signboard or other substrate. The term "release liner" is used herein to describe sheet material which has a release agent, e.g. silicone, coated on one of its exposed flat surfaces. The release agent permits a release liner that is temporarily affixed to the adhesive surface of a label to be easily peeled from the label when it is desired to affix the label to a surface.

Figure 1:
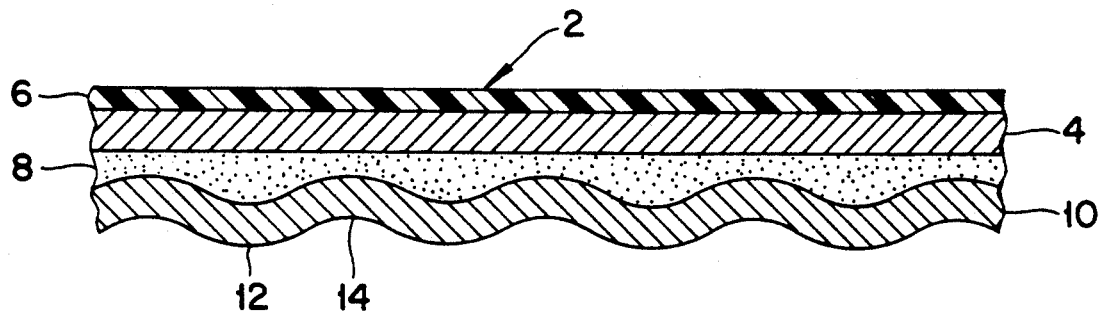
FIG. 1 is a cross sectional view, greatly enlarged, of one embodiment of the non-shrinking and non-swelling release liner of the invention.

FIG. 1 shows the release liner of the invention, generally designated by reference numeral 2. The release liner comprises a sheet of flat paper 4 having a release coating 6 on its upper surface and an adhesive coating 8 on its lower surface, and a sheet of embossed paper 10, which is bonded to flat paper 4 by means of adhesive coating 8.

Sheet 4 may be manufactured from any fibrous cellulose material in sheet form made by chemical, mechanical or chemical-mechanical processes, but it is preferably made from kraft paper. One of the principal purposes of flat sheet 4 is to provide an insulating layer between embossed sheet 10 and the face sheet of the label, both of which are described in detail below. Accordingly, sheet 4 is preferably a paper having a smooth surface and a caliper great enough to prevent the design or raised pattern of embossed sheet 10 from being imprinted on the face sheet of the label when the two are pressed together. Sheet 4 also serves to provide support for the label and thus is preferably rigid enough to resist folding or wrinkling. In general, sheet 4 is usually made of 15 to 100 pounds per ream paper and usually has a caliper in the range of about 1.5 to about 12 mils and preferably has a caliper in the range of about 2 to about 6 mils.

Release coating 6 serves the function of providing easy removal of an adhesive-backed label from the release liner of the invention. The release layer permits the adhesive-coated surface of the label to adhere lightly to the top surface 24 of the release liner but prevents the adhesive from sticking fast to the release liner. The specific release agent used on the release liner is not a part of the invention and, in general, any release agent can be used. The suitability of commercially available release agents can be determined experimentally. Release agents generally considered as preferable include cured silicones (polymethylsiloxanes). A number of commercial curable silicones are available for this purpose, including Syl-off 23, a curable silicone rubber polymer manufactured by Dow Corning Company, and radiation-curable Type RC-450 silicone, sold by Goldschmidt Company.

Release coating 6 may be applied to sheet 4 by any conventional technique. Typical coating procedures include gravure rolling, which is the preferred technique for applying viscous release agents and spraying, which can be used with less viscous release agents. After the release agent is applied to the surface of flat sheet 4 it is usually dried and cured prior to applying the adhesive to the bottom of sheet 4.

The release liner resists shrinkage and swelling because the passage of moisture from or to sheet 4 is prevented or retarded. As noted below, the bottom surface of sheet 4 is made water-impermeable by the coating of water-impermeable adhesive between flat sheet 4 and embossed sheet 10. In one embodiment of the invention, the release agent coating on the top surface of sheet 4 serves to impede or prevent the passage of moisture from or to sheet 4. In an alternate embodiment of the invention the water-impermeable adhesive on the bottom of the label impedes or prevents the passage of moisture through the top surface of sheet 4. It may also sometimes be desired to further enhance the moisture impermeability of sheet 4. This may be accomplished by coating its top surface with a sealant such as size.

Embossed or textured paper sheet 10 provides rigidity to the release liner. The two-ply construction comprising embossed sheet 10 and flat paper 4 resists folding and wrinkling. The embossed paper also helps the release liner to resist curling because of its ability to compensate for shrinkage or swelling caused by moisture loss or gain. Like flat sheet 4, embossed sheet 10 may also be made from any fibrous cellulosic material by chemical, mechanical or chemical-mechanical processes, but it too is preferably kraft paper. Embossed sheet 10 is preferably made with paper having a weight of about 15 to about 100 pounds per ream and has a caliper generally in the range of about 1.5 to about 12 mils and preferably in the range of about 2 to about 6 mils. In the embodiment of the release liner illustrated in FIG. 1 embossed paper 10 is of corrugated construction and has ridges 12 and valleys 14. The corrugated construction of sheet 10 compensates for shrinkage or swelling of the paper, thus imparting dimensional stability to the sheet. The textured pattern of sheet 10 may be of any design. For most applications, however, the embossing is desirably fine-grained to reduce the tendency of the embossing to imprint the face sheet of the label during manufacture of the label or during the printing of information on the label. U.S. Pat. No. 3,944,692, issued to Swenson, describes embossed paper release liners. The paper disclosed therein is typical of the types of construction that embossed sheet 10 may have and the disclosure of this patent is incorporated herein by reference.

Adhesive layer 8 bonds flat sheet 4 to embossed sheet 10. It also provides a moisture barrier for flat sheet 4 thus preventing moisture from entering or leaving sheet 4 through its bottom surface. The adhesive of layer 8 may be any moisture impermeable adhesive substance which forms a permanent bond but which also allows some in-plane mobility to the lamination. For example, the adhesive may be a thermosetting adhesive, such as cellulose acetate-polyvinyl chloride resin, a water activated adhesive, such as polyvinyl alcohol, or a pressure-sensitive adhesive, such an acrylate-based or a rubber-based adhesive and mixtures of these. The particular adhesive used as coating 8 is a matter of choice and forms no part of this invention.

Figure 2:
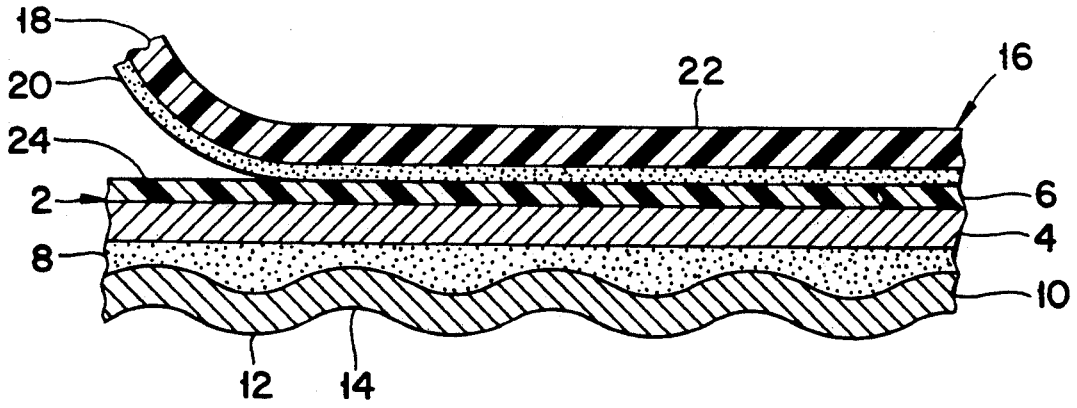
FIG. 2 is a cross sectional view, greatly enlarged, of one embodiment of the non-curling label of the invention, showing the label partly pulled away from the release liner.

FIG. 2 illustrates a label, generally designated as 16, comprised of a sheet of face material 18 and a coating of pressure-sensitive adhesive 20. Face material 18 may be made of from any moisture-insensitive substance such as treated paper or polymeric sheet material. As noted above the full benefit of using the non-shrinking release liner is realized when the face sheet of the label is made of a water insensitive material which does not undergo shrinkage upon being subjected to heat. Sheet 18 is preferably made from a synthetic polymeric film material, such as polyvinyl chloride, polypropylene polyester films or mixtures of these. A particularly preferred material for use in sheet 18 is polyvinyl chloride. Polymeric compositions used in the manufacture of sheet 18 may contain fillers, such as whitening agents, etc. If desired, the top surface 22 of face sheet 18 may be treated to harden it or make it resistant to dirt or stains.

Adhesive 20 may be any moisture-impermeable pressure-sensitive adhesive. As noted above, when the label is attached to the release liner adhesive 20 also serves to prevent or impede the passage of moisture through the top surface of sheet 4. The adhesive may be of the permanent type such that label 16 will not be removable from the surface to which it is affixed, or it may be of the non-permanent type, i.e. one which permits the label to be removed from one surface and applied to another, as desired.

In the manufacture of the label products depicted in FIG. 2, the adhesive-coated surface of label 16 is pressed against the top surface 24 of release liner 2. The release agent 6 and the water-impermeable adhesive 20 serve to render the top surface of flat sheet 4 water impermeable. Thus, in the construction shown in FIG. 2, the release liner will not shrink when the label is subjected to heat because the top surface of sheet 4 is substantially sealed against moisture loss by the release agent and/or adhesive layer 20 and the bottom surface of sheet 4 is similarly sealed against moisture loss by adhesive layer 8. The bottom surface of embossed sheet 10 does not require sealing since embossed sheet 10 does not appreciably shrink or swell upon loss or gain of moisture.

The benefits of the invention are further illustrated in the following examples.

EXAMPLE I

A release liner was made by the following procedure:

A thin uniform coating of a water-based acrylic emulsion pressure-sensitive adhesive (sold by National Starch and Adhesives Company under the designation National Adhesives 72-9675) was applied to the bottom surface of a sheet of smooth kraft release paper (sold by Akrosil Company under the designation Akrosil®). The release paper had a basis weight of 40 pounds per 3000 square feet and its top surface was coated with a thin uniform coating of 4G/O silicone. After the adhesive coating dried, the sheet of smooth kraft paper was laminated to a sheet of embossed kraft paper having evenly distributed sinusoidal undulations. The embossed kraft paper had a basis weight of 30 pounds per 3000 square feet. The two sheets of paper were bonded together by pressing the adhesive-coated surface of the smooth kraft paper to the embossed paper.

A pressure-sensitive adhesive-backed label was made by applying a thin uniform coating of Ashland 1085 adhesive (sold by Ashland Chemical Company) onto one surface of a sheet of polyvinyl chloride film having a basis weight of 80 pounds per 3000 square feet (3.8 mils thickness). Upon drying, the adhesive became pressure-sensitive.

The adhesive-backed label was adhered to the release liner by pressing the adhesive-coated surface of the label to the release agent-coated surface of the release liner. The label was securely attached to the release liner but could be easily removed from it by peeling.

EXAMPLE II

A message was printed xerographically onto the face of the release liner-backed label made in Example I by means of a laser printer. The label was removed from the laser printer and examined. It was found to lay flat and exhibited no visible signs of curling.

Although the invention has been described by reference to specific examples, the invention is not limited thereto and variations of the product of the example are contemplated. For example, the release liner may be constructed by sandwiching a sheet of embossed paper between two sheets of adhesive-coated smooth paper release sheets to form a two-faced release liner. Similarly, the label may be made from other polymeric material or from non-polymeric material and mixtures of these. The scope of the invention is limited only by the breadth of the appended claims.

I claim:

1. A release liner comprising a layer of untextured paper having on one side thereof a moisture-resistant release coating and on the other side thereof a moisture-impermeable adhesive and a layer of embossed paper adhered to the other side of said adhesive coating.

2. The release liner of claim 1 wherein said release coating comprises a silicone polymer.

3. The release liner of claim 1 wherein said moisture-impermeable adhesive is selected from the group consisting of water-based adhesives, solvent-based adhesives and hot melt adhesives.

4. The release liner of claim 1 wherein said untextured paper is a kraft paper.

5. The release liner of claim 1 wherein said embossed paper is patterned.

6. The release liner of claim 1 wherein said embossed paper is corrugated.

7. A label comprising (a) a layer of sheet material having a printable upper surface and a moisture-impermeable adhesive-coated lower surface, and (b) a release liner comprising a first layer of paper having a release coating on one surface thereof and a moisture-impermeable adhesive on the other surface thereof and a second layer of paper which is embossed and bonded to said first layer of paper by means of said moisture-impermeable adhesive on said other surface of said first layer of paper.

8. The label of claim 7 wherein said layer of sheet material is selected from the group consisting of paper and synthetic polymeric films.

9. The label of claim 7 wherein the moisture-impermeable adhesive is selected from the group consisting of water based adhesives, solvent-based adhesives and hot melt adhesives.

10. The label of claim 7 wherein said first layer of paper is smooth kraft paper.

11. The label of claim 7 wherein said embossed paper is corrugated.

12. The label of claim 7 wherein said release coating comprises a silicone polymer.

13. The label of claim 7 wherein said layer of sheet material is a synthetic polymeric film selected from the group consisting of polyvinyl chloride film, polypropylene film and polyester film.

14. A xerographically printable label comprising (a) a sheet of polymeric film having a printable upper surface and a moisture-impermeable pressure-sensitive adhesive coated on its lower surface, and (b) a release liner comprising a sheet of non-embossed paper having a release agent coated onto one surface thereof and a moisture-impermeable adhesive coating on the other surface thereof, and a sheet of embossed paper which is bonded to said layer of non-embossed paper by means of said moisture-impermeable adhesive coating on said other surface of the non-embossed paper sheet.

15. The label of claim 14 wherein said polymeric film is selected from the group consisting of polyvinyl chloride film, polypropylene film and polyester film.

16. The label of claim 15 wherein said release agent comprises a silicone polymer.

17. The label of claim 16 wherein said polymeric film is polyvinyl chloride.

18. A xerographically printable label of claim 14 wherein said embossed paper is corrugated.

* * * * *